US005196110A

United States Patent [19]

Swart et al.

[11] Patent Number: 5,196,110

[45] Date of Patent: Mar. 23, 1993

[54] HYDROGEN RECYCLE BETWEEN STAGES OF TWO STAGE FIXED-BED/MOVING-BED UNIT

[75] Inventors: Gerrit S. Swart, Westfield; Paul W. Kamienski, Basking Ridge, both of N.J.; Stuart S. Goldstein, Ewell, England; David W. Staubs, Morris Plains, N.J.; George A. Swan, III, Baton Rouge, La.

[73] Assignee: Exxon Research and Engineering Company, Florham Park, N.J.

[21] Appl. No.: 805,349

[22] Filed: Dec. 9, 1991

[51] Int. Cl.[5] ..... C10G 59/02

[52] U.S. Cl. ..... 208/65; 208/64; 208/63

[58] Field of Search ..... 208/79, 63, 65

[56] References Cited

U.S. PATENT DOCUMENTS

| | | | |
|---|---|---|---|
| 2,767,124 | 10/1956 | Myers | 208/79 |
| 2,866,745 | 12/1958 | Heinemann | 208/79 |
| 3,013,088 | 12/1961 | Merryfield | 208/79 |
| 3,384,571 | 5/1968 | Engel | 208/79 |
| 3,432,425 | 3/1969 | Bodian et al. | 208/79 |
| 3,753,891 | 8/1973 | Craven et al. | 208/65 |
| 3,864,240 | 2/1975 | Slone | 208/64 |
| 3,883,418 | 5/1975 | Drehmannett | 208/65 |
| 3,992,465 | 11/1976 | Juguin et al. | 208/64 |
| 4,002,555 | 1/1977 | Famham | 208/79 |
| 4,737,262 | 4/1980 | Frack et al. | 208/65 |
| 4,985,132 | 1/1991 | Moser et al. | 208/65 |
| 5,043,057 | 8/1991 | Boyle | 208/65 |

*Primary Examiner*—Helane E. Myers
*Attorney, Agent, or Firm*—Henry E. Naylor

[57] ABSTRACT

A two stage catalytic reforming process. The first stage is comprised of two separate fixed-bed reforming units each comprised of one or more serially connected fixed-bed reforming zones. The second stage is comprised of one or more moving-bed reforming zones with continual catalyst regeneration. A hydrogen-rich gaseous stream is separated after each fixed-bed unit and a portion is recycled to the respective fixed-bed reforming zones.

10 Claims, 1 Drawing Sheet

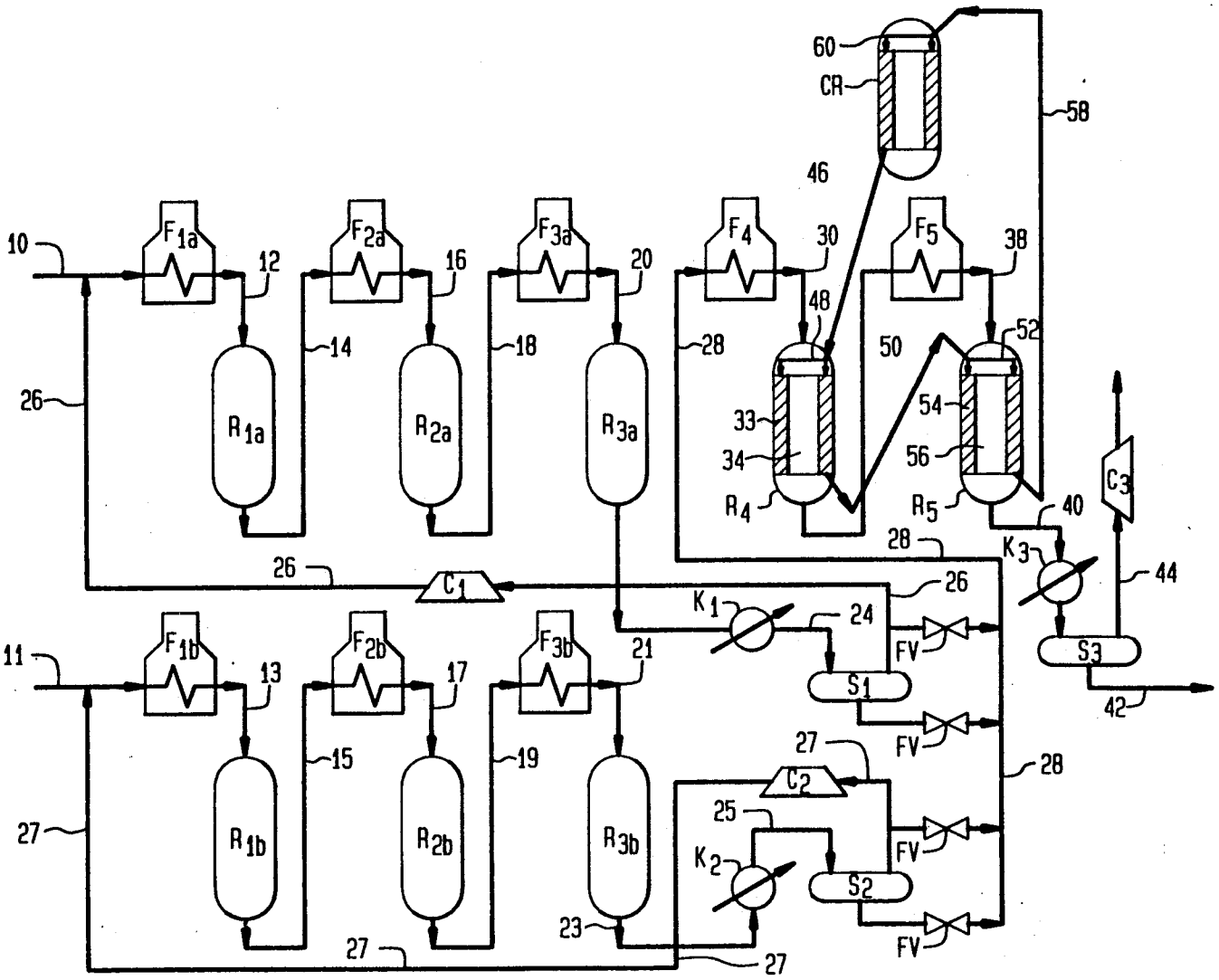
C3
44
42
S3
58
40
K3
52
38
28
F5
54
56
R5
26
FV
FV
FV
FV
50
28
S1
S2
60
CR
46
30
48
24
27
C2
F4
33
34
R4
K1
25
K2
27
28
20
R3a
21
R3b
23
F3a
F3b
18
19
16
R2a
C1
17
R2b
F2a
F2b
14
15
26
27
12
R1a
13
R1b
F1a
F1b
10
26
11
27

HYDROGEN RECYCLE BETWEEN STAGES OF TWO STAGE FIXED-BED/MOVING-BED UNIT

FIELD OF THE INVENTION

The present invention relates to a two stage catalytic reforming process. The first stage is comprised of two separate fixed-bed reforming units each comprised of one or more serially connected fixed-bed reforming zones. The second stage is comprised of one or more moving-bed reforming zones with continual catalyst regeneration. A hydrogen-rich gaseous stream is separated after each fixed-bed unit of said first stage and a portion recycled to the respective fixed-bed reforming zones.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst is continuously regenerated in a separate regeneration vessel.

With the gradual phasing out of lead from the gasoline pool and with the introduction of premium grade lead-free gasoline in Europe and the United States, petroleum refiners must re-evaluate how certain refinery units are run to meet this changing demand for higher octane fuels without the use of lead. Because catalytic reforming units produce product streams which represent the heart of the gasoline pool, demands are being put on these units for generating streams with ever higher octane ratings.

U.S. Pat. No. 3,992,465 teaches a two stage reforming process wherein a first stage is comprised of at least one fixed-bed reforming zone and the second stage is comprised of a moving-bed reforming zone. The teaching of U.S. Pat. No. 3,992,465 is primarily to subject the reformate, after second stage reforming to a series of fractionations and an extractive distillation on the $C_6$–$C_7$ cut to obtain an aromatics-rich stream.

While such process schemes have commercial promise, there still remains a need in the art for improved reforming processes that can take advantage of the both fixed-bed and moving-bed reactor design, without the need for a new grass roots unit.

SUMMARY OF THE INVENTION

In accordance with the present invention, there is provided an improved process for catalytically reforming a gasoline boiling range hydrocarbon reactant stream in the presence of hydrogen in a reforming process unit comprised of a plurality of reforming zones wherein each of the reforming zones contains a reforming catalyst comprised of one or more Group VIII noble metals on a refractory support. The catalyst may be either monofunctional or bifunctional. The improved process comprises:

(a) reforming two separate reactant streams in two separate fixed-bed reforming process units, each comprised of one or more serially connected reforming zones containing a fixed-bed of catalyst comprised of one or more Group VIII noble metals on a refractory support, which one or more reforming zones are operated at reforming conditions which includes a pressure of about 100 to 500 psig, thereby producing a first effluent stream for each unit;

(b) passing the effluent stream from each fixed-bed process unit through a separate separation zone to produce a hydrogen-rich gaseous stream and a predominantly $C_5$+ liquid stream from each effluent stream;

(c) recycling a portion of each of the two hydrogen-rich gaseous streams to the respective fixed-bed reforming zone;

(d) passing said remaining portion of the hydrogen-rich gaseous streams, along with the two $C_5$+ liquid streams, to a second reforming stage, which is operated at a pressure of at least about 50 psig lower than that of the first reforming stage, which second stage is comprised of one or more serially connected reforming zones which are operated in a moving-bed continuous catalyst regeneration mode, wherein the catalyst continually descends through the reforming zone, exits, and is passed to a regeneration zone where at least a portion of any accumulated carbon is burned-off, and wherein the regenerated catalyst is recycled back to the one or more moving-bed reforming zones; and (e) passing the resulting effluent stream from said second reforming stage to a separation zone wherein another hydrogen-rich gaseous stream and a predominantly $C_5$+ liquid stream are produced, and wherein both streams are collected or passed to further refinery processing.

In preferred embodiments, the Group VIII noble metal for catalysts in all stages is platinum.

In still other preferred embodiments of the present invention, the catalyst of the final stage is comprised of platinum and tin on a spherical alumina support material.

In yet another preferred embodiment of the present invention, aromatics are separated from the effluent stream between the fixed-bed first stage and the moving-bed second stage and the resulting aromatics-lean stream is sent for reforming to the second stage.

BRIEF DESCRIPTION OF THE FIGURE

The sole FIGURE hereof depicts a simplified flow diagram of a preferred reforming process of the present invention. The reforming process unit is comprised of a first stage which includes two fixed-bed process units operating independently, and wherein the effluent stream from each of the fixed-bed process units is passed to a separation zone which results in a hydrogen-rich gaseous stream and a predominantly $C_5+$ liquid stream. A portion of each of the hydrogen-rich gaseous streams is recycled to the respective fixed-bed reforming zones and the remaining portion of the hydrogen-rich gaseous stream, along with the $C_5+$ liquid streams, are passed to a second reforming stage which is comprised of one or more moving-bed continuous catalyst regeneration zones.

DETAILED DESCRIPTION OF THE INVENTION

Feedstocks, also sometimes referred to herein as reactant streams, which are suitable for reforming in accordance with the present invention, are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphthas, synthetically produced naphthas such as coal and oil-shale derived naphthas, thermally or catalytically cracked naphthas, hydrocracked naphthas, or blends or fractions thereof.

Referring to the sole FIGURE hereof, two gasoline boiling range hydrocarbon reactant streams, which are preferably first hydrotreated by any conventional hydrotreating method to remove undesirable components such as sulfur and nitrogen, are passed to a first reforming stage represented by two parallel banks of heater or preheat furnaces $F_{1a}$, $F_{2a}$, $F_{3a}$, and $F_{1b}$, $F_{2b}$, and $F_{3b}$, and reforming zones $R_{1a}$, $R_{2a}$, $R_{3a}$, and $R_{1b}$, $R_{2b}$, and $R_{3b}$ respectively. A reforming stage, as used herein, is any one or more reforming zones, in this FIGURE reactors, and their associated equipment (e.g., preheat furnaces etc.). The parallel reforming units set forth in the FIGURE hereof would represent two existing reforming units which are already in-place in a refinery. The reactant streams are fed into heaters, or preheat furnaces, $F_{1a}$, and $F_{1b}$ via lines 10 and 11 respectively where they are heated to an effective reforming temperature. That is, to a temperature high enough to initiate and maintain dehydrogenation reactions, but not so high as to cause excessive hydrocracking. The heated reactant streams are then fed, via lines 12 and 13, into reforming zones $R_{1a}$ and $R_{1b}$, which contain a catalyst suitable for reforming. Reforming zones $R_{1a}$ and $R_{1b}$, as well as all the other reforming zones in this first stage, are operated at reforming conditions. Typical reforming operating conditions for the reactors of this first fixed-bed stage include temperatures from about 800° to about 1200° F.; pressures from about 100 psig to about 500 psig, preferably from about 150 psig to about 300 psig; a weight hourly space velocity (WHSV) of about 0.5 to about 20, preferably from about 0.75 to about 5 and a hydrogen to oil ratio of about 1 to 10 moles of hydrogen per mole of $C_5+$ feed, preferably 1.5 to 5 moles of hydrogen per mole of $C_5+$ feed.

The effluent streams from reforming zones $R_{1a}$ and $R_{1b}$ are fed to preheat furnaces $F_{2a}$ and $F_{2b}$ via lines 14 and 15, then to reforming zones $R_{2a}$ and $R_{2b}$ via lines 16 and 17, then through preheat furnaces $F_{3a}$ and $F_{3b}$ via lines 18 and 19, then to reforming zones $R_{3a}$ and $R_{3b}$ via lines 20 and 21. Each of the effluent streams from this first stage are sent to cooling zones $K_1$ and $K_2$ via lines 22 and 23, where they are cooled to condense a liquid phase to a temperature within the operating range of the recycle gas separation zones, which are represented in the FIGURE hereof by a separation drums $S_1$ and $S_2$. The temperature will generally range from about 60° to about 300° F., preferably from about 80 to 125° F. The cooled effluent stream is then fed to separation zones $S_1$ and $S_2$ via lines 24 and 25 where each is separated into a hydrogen-rich gaseous stream and a heavier liquid stream. The preferred separation would result in a hydrogen-rich predominantly $C_4-$ gaseous stream and a predominantly $C_5+$ liquid stream. It is understood that these streams are not pure streams. For example, the separation zone will not provide complete separation between the $C_4-$ components and the $C_5+$ liquids. Thus, the gaseous stream will contain minor amounts of $C_5+$ components and the liquid stream will contain minor amounts of $C_4-$ components and hydrogen.

A portion of each of the hydrogen-rich gaseous streams is recycled to the respective fixed-bed reforming units via lines 26 and 27 by first passing them through compressors $C_1$ and $C_2$ respectively, to bring the recycle streams to reforming pressures. About 40 to 90 vol. %, preferably about 50 to 85 vol. %, of the hydrogen-rich gaseous streams will be recycled. Of course, during start-up, the unit is pressured-up with hydrogen from an independent source until enough hydrogen can be generated in the first stage for recycle. The remaining portions of the hydrogen-rich gaseous streams, and the $C_5+$ streams are combined and passed to furnace $F_4$ of second stage reforming via line 28 after each stream is passed through pressure control valves PV where pressure is reduced to the level required for second stage operation. The amount of pressure reduction will depend on the operating pressure of the second stage separation zone $S_3$ and the pressure drop in furnaces $F_4$ and $F_5$ and reactors $R_4$ and $R_5$, and the connecting piping.

The heated reaction stream from furnace $F_4$ is passed to reforming zone $R_4$ via line 30, which reforming zone is operated in a continuous moving-bed mode. Such reforming zones, or reactors, are well known in the art and are typical of those taught in U.S. Pat. Nos. 3,652,231; 3,856,662; 4,167,473; and 3,992,465 which are all incorporated herein by reference. The general principle of operation of such reforming zones is that the catalyst is contained in a annular bed formed by spaced cylindrical screens within the interior of the reactor. The reactant stream is processed through the catalyst bed, typically in an out-to-in radial flow; that is, it enters the reactor at the top and flows radially from the reactor wall through the annular bed of catalyst 32, which is descending through the reactor, and passes into the cylindrical space 34 created by said annular bed. The effluent stream from reforming zone $R_4$ is passed via line 36 to furnace $F_5$, then to reforming zone $R_5$ via line 38, which is also operated in a moving-bed continuous catalyst regeneration mode. The reactant stream is processed through the catalyst bed, in an out-to-in radial flow, as described for reforming zone $R_4$, where it enters the reactor at the top and flows radially from the reactor wall through the annular bed of catalyst 54, which is descending through the reactor, and passes into the cylindrical space 56 created by said annular bed.

Reforming conditions for the moving-bed reforming zones will include temperatures from about 800° to 1200° F., preferably from about 800° to 1000° F.; pressures from about 30 to 300, preferably from about 50 to 150 psig; a weight hourly space velocity from about 0.5 to 20, preferably from about 0.75 to 6. Hydrogen-rich gas should be provided to maintain the hydrogen to oil ratio between the range of about 0.5 to 5, preferably from about 0.75 to 3. In the preferred embodiment, all of the hydrogen gas is supplied by the hydrogen-rich predominantly $C_4^-$ gaseous stream which passes flow control valves FV. Instances may exist in which the gas flowing from the first stage is insufficient to supply the needed hydrogen to oil ratio. This could occur if the feedstock to the first stage was highly paraffinic or had a boiling range which included predominantly hydrocarbons in the 6 to 8 carbon number range. In these instances, hydrogen would need to be supplied from external sources such as an additional reforming unit or a hydrogen plant.

The resulting effluent stream from reforming zone $R_5$ is passed via line 40 to cooling zone $K_3$ where the temperature of the stream is dropped to about 60° to 300° F., preferably from about 80° to 125° F. It is then passed into separation zone $S_3$ where it is separated into a hydrogen-rich predominantly $C_4^-$ gaseous stream, and a predominantly $C_5^+$ liquid stream. The $C_5^+$ stream is collected for blending in the gasoline pool via line 42. The hydrogen-rich predominantly $C_4^-$ stream is collected via line 44, where it is preferably compressed via compressor $C_3$ and stored as product gas or sent to further processing.

Fresh or regenerated catalyst is charged to reforming zone $R_4$ by way of line 46 and distributed in the annular moving bed 32 by means of catalyst transfer conduits 48, the catalyst being processed downwardly as an annular dense-phase moving bed. The reforming catalyst charged to reforming zones $R_4$ and $R_5$ is comprised of at least one Group VIII noble metal, preferably platinum; and one or more promoter metals, preferably tin, on spherical particles of a refractory support, preferably alumina. The spherical particles have an average diameter of about 1 to 3 mm, preferably about 1.5 to 2 mm, the density in bulk of this solid being from about 0.5 to 0.9 and more particularly from about 0.5 to 0.8.

The catalyst of reforming zone $R_4$ descends through the reforming zone and exits and is passed to reforming zone $R_5$ via line 50 and distributed in the annular moving bed 54 by means of catalyst transfer conduits 52, the catalyst also being processed downwardly as an annular dense-phase moving bed. The catalyst exits the bottom of reforming zone $R_5$ and is passed to catalyst regeneration zone CR via line 58 and transfer conduit 60 where accumulated carbon is burned-off at conventional conditions. The catalyst regeneration zone CR represents all of the steps required to remove at least a portion of the carbon from the catalyst and return it to the state needed for the reforming reactions occurring in reforming zones $R_4$ and $R_5$. The specific steps included in the catalyst regeneration zone CR will vary with the selected catalyst. The only required step is one where accumulated carbon is burned-off at temperatures from about 600° to 1200° F. and in the presence of an oxygen-containing gas, preferably air. Additional steps which may also be contained in the catalyst regeneration equipment represented by CR include, but are not limited to, adding a halide to the catalyst, purging carbon oxides, redispersing metals, and adding sulfur or other compounds to lower the rate of cracking when the catalyst first enters the reforming zone. The regenerated catalyst is then charged to reforming zone $R_4$ via line 46 and the cycle of continuous catalyst regeneration is continued until the entire reforming unit (both stages) is shut down, such as for mechanical maintenance or inspection. It is to be understood that the catalyst in the moving-bed reforming and regeneration zones may not be constantly moving, but may only move intermittently through the system. This may be caused by the opening an closing of various valves in the system. Thus, the word "continuous" is not to be taken literally and the word "continual" is sometimes used interchangeably with "continuous".

The moving-bed zones of the second stage may be arranged in series, side-by-side, each of them containing a reforming catalyst bed slowly flowing downwardly, as mentioned above, either continuously or, more generally, periodically, said bed forming an uninterrupted column of catalyst particles. The moving bed zones may also be vertically stacked in a single reactor, one above the other, so as to ensure the downward flow of catalyst by gravity from the upper zone to the next below. The reactor then consists of reaction zones of relatively large sections through which the reactant stream, which is in a gaseous state, flows from the periphery to the center or from the center to the periphery interconnected by catalyst zones of relatively small sections, the reactant stream issuing from one catalyst zone of large section may be divided into a first portion (preferably from 1 to 10%) passing through a reaction zone of small section for feeding the subsequent reaction zone of large section and a second portion (preferably from 99 to 90%) sent to a thermal exchange zone and admixed again to the first portion of the reactant stream at the inlet of the subsequent catalyst zone of large section.

When using one or more reaction zones with a moving bed of catalyst, said zones, as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift", not shown. The fluid of the lift used for conveying the catalyst may be any convenient gas, for example nitrogen or still for example hydrogen and more particularly purified hydrogen or recycle hydrogen.

It is also within the scope of this invention that an aromatics separation be done on the effluent stream between stages. That is, the effluent stream would be passed to an aromatics separation zone where aromatic materials are separated in one or more steps to produce an aromatics-rich stream, an aromatics-lean stream, and optionally a stream containing predominantly $C_5$ and lighter hydrocarbons which comprise a portion of the aromatics-lean stream. This optional stream might be required to effect an economical separation of the remaining $C_6$+ product and can be removed as product or may be mixed back with the aromatics-lean stream for processing in the second stage. The aromatics-rich stream would be routed to motor gasoline blending. The terms "aromatics-rich" and "aromatics-lean" as used herein refer to the level of aromatics in the liquid fraction reaction stream after aromatic separation relative to the level of aromatics prior to separation. That is, after a reaction stream is subjected to an aromatics separation, two fractions result. One fraction has a higher level of aromatics relative to the stream before separation and is thus referred to as the aromatics-rich fraction. The other fraction is, of course, the aromatics-lean fraction which can also be referred to as the paraffin-rich fraction. Aromatics separation can be accomplished by any suitable method. Non-limiting methods suitable for use herein for aromatics separation include: extraction, extractive distillation, distillation, flashing, adsorption, and by permeation through a semipermeable membrane, or by any other appropriate aromatics or paraffins removal process. Preferred are extractive distillation, distillation, and flashing.

Both the aromatics-rich and the aromatics-lean streams will also contain paraffinic and naphthenic material. The aromatics-rich stream, because of the relatively high level of aromatic components, would have a relatively high octane value.

Catalysts suitable of use in any of the reactors of any of the stages include both monofunctional and bifunctional, monometallic and multimetallic noble metal containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the second stage reforming must be in the form of spherical particles as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.1 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide, bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

By practice of the present invention, reforming is conducted more efficiently and results in increased hydrogen and $C_5$+ liquid yields. The first stage reactors are fixed-bed reactors operated at conventional reforming temperatures and pressures in semiregenerative or cyclic mode while the reactors of the second stage are moving bed reactors operated substantially at lower pressures. The second stage reforming zones will typically be operated at least about 50 psig lower in pressure than those of the first stage. Such pressures in the second stage may be from as low as about 30 psig to about 100 psig. More particularly, the downstream reactors can be operated in once-through gas mode because there is an adequate amount of hydrogen generated, that when combined with the hydrogen-rich gas stream from the first stage, is an adequate amount of hydrogen to sustain the reforming reactions taking place.

The second stage reactors, when operated in a once-through hydrogen-rich gas mode, permit a smaller product-gas compressor ($C_2$ in the FIGURE) to be substituted for a larger capacity recycle gas compressor. Pressure drop in the second stage is also reduced by virtue of once-through gas operation. Of course, the second stage reactors can be operated in a mode wherein the hydrogen-rich gas is recycled.

Various changes and/or modifications, such as will present themselves to those familiar with the art may be made in the method and apparatus described herein without departing from the spirit of this invention whose scope is commensurate with the following claims.

What is claimed is:

1. A process for catalytically reforming a gasoline boiling range hydrocarbon reactant stream in the presence of hydrogen in a reforming process unit comprised of a plurality of reforming zones wherein each of the reforming zones contains a reforming catalyst comprised of one or more Group VIII noble metals on a refractory support, which process comprises:

(a) reforming two separate reactant streams in two separate fixed-bed reforming process units, each comprised of one or more serially connected reforming zones containing a fixed-bed of catalyst comprised of one or more Group VIII noble metals on a refractory support, which one or more reforming zones are operated at reforming conditions which includes a pressure of about 100 to 500 psig, thereby producing a first effluent stream for each unit;

(b) passing the effluent stream from each fixed-bed process unit through a separate separation zone to produce a hydrogen-rich gaseous stream and a predominantly $C_5$+ stream from each effluent stream;

(c) recycling a portion of each of the two hydrogen-rich gaseous streams to the respective fixed-bed reforming zones;

(d) passing said remaining portion of the hydrogen-rich gaseous streams, along with the two $C_5+$ liquid streams, to a second reforming stage comprised of one or more serially connected reforming zones which are operated in a moving-bed continual catalyst regeneration mode wherein the catalyst in comprised of one or more Group VIII noble metals on a refractory support, which catalyst continually descends through the reforming zone, exits, and is passed to a regeneration zone where at least a portion of any accumulated carbon is burned-off, and wherein the regenerated catalyst is recycled back to the one or more moving-bed reforming zones; and (e) passing the resulting effluent stream from said second reforming stage to a separation zone wherein another hydrogen-rich gaseous stream and a predominantly $C_5+$ liquid stream are produced, and wherein both streams are collected or passed to further refinery processing.

2. The process of claim 1 wherein the catalyst in each of the reforming zones of the first stage is comprised of about 0.01 to 5 wt. % platinum, and about 0.01 to 5 wt. % of at least one metal selected from the group consisting of iridium, rhenium, and tin.

3. The process of claim 1 wherein the catalyst of each of the reforming zones of the second stage is comprised of about 0.01 to 5 wt. % platinum, 0.01 to 5 wt. % tin, on substantially spherical particles of a refractory support.

4. The process of claim 3 wherein the amount of platinum and tin are each from about 0.1 to 2 wt. % and the spherical refractory support particles are comprised of alumina.

5. The process of claim 3 wherein the catalyst in each of the first stage reforming zones is comprised of about 0.01 to 5 wt. % platinum, and about 0.01 to 5 wt. % of at least one metal selected from the group consisting of iridium, rhenium, and tin.

6. The process of claim 1 wherein: (i) the first reforming stage contains 2 or 3 fixed-bed reforming zones for each fixed-bed process unit, and (ii) the second reforming stage contains one or two moving-bed reforming zones, with the proviso that when two moving-bed reforming zones are employed, the catalyst descends through a first moving-bed reforming zone, is passed to the second moving-bed reforming zone where it descends through said second moving-bed reforming zone, then is passed to a regeneration zone where any accumulated carbon is burned-off, after which the regenerated catalyst is recycled to said first moving-bed reforming zone.

7. The process of claim 6 wherein: (i) the catalyst in each reforming zone of said first reforming stage is comprised of about 0.01 to 5 wt. % platinum, about 0.01 to 5 wt. % of at least one metal selected from the group consisting of iridium, rhenium, and tin; and (ii) the catalyst in each of the reforming zones of said second stage is comprised of about 0.1 to 2 wt. % platinum, and about 0.1 to 2 wt. % tin on substantially spherical refractory support.

8. The process of claim 1 wherein the effluent stream between stages is subjected to an aromatics separation thereby resulting in an aromatics-rich stream and an aromatics-lean stream, wherein the aromatics-rich stream is collected and the aromatics-lean stream is sent to the second reforming stage.

9. The process of claim 7 wherein the effluent stream between stages is subjected to an aromatics separation thereby resulting in an aromatics-rich stream and an aromatics-lean stream, wherein the aromatics-rich stream is collected and the aromatics-lean stream is sent to the second reforming stage.

10. The process of claim 1 wherein at least a portion of the predominantly $C_5+$ liquid stream produced by one or more of said first stage reforming units is removed as a product stream.

* * * * *